US005238647A

United States Patent [19]

Mitsuyoshi et al.

[11] Patent Number: 5,238,647

[45] Date of Patent: Aug. 24, 1993

[54] TITANIUM ALLOYS WITH EXCELLENT CORROSION RESISTANCE

[75] Inventors: Yasuhiro Mitsuyoshi; Kazuhiro Taki, both of Kanagawa, Japan

[73] Assignee: Nippon Mining and Metals Company Limited, Tokyo, Japan

[21] Appl. No.: 797,529

[22] Filed: Nov. 25, 1991

[30] Foreign Application Priority Data

Dec. 26, 1990 [JP] Japan ..... 2-413977
Jul. 19, 1991 [JP] Japan ..... 3-203744

[51] Int. Cl.[5] ..... C22C 14/00

[52] U.S. Cl. ..... 420/421; 148/421; 420/417

[58] Field of Search ..... 420/417, 421; 148/421

[56] References Cited

U.S. PATENT DOCUMENTS

| | | | |
|---|---|---|---|
| 2,588,007 | 3/1952 | Jaffee | 420/421 |
| 2,819,960 | 1/1958 | Bomberger | 420/421 |
| 2,829,974 | 4/1958 | Finlay et al. | 75/175.5 |
| 2,857,269 | 10/1958 | Vordahl | 148/421 |
| 3,063,835 | 11/1962 | Stern | 420/421 |
| 4,666,666 | 5/1987 | Taki et al. | 420/421 |

FOREIGN PATENT DOCUMENTS

| | | | |
|---|---|---|---|
| 0006471 | 1/1980 | Japan | 420/421 |
| 710584 | 6/1954 | United Kingdom . | |
| 8519 | 6/1960 | United Kingdom . | |

OTHER PUBLICATIONS

Froes et al Jour of Metals, Jul. 1985, p. 28.

*Primary Examiner*—Upendra Roy
*Attorney, Agent, or Firm*—Seidel, Gonda, Lavorgna & Monaco

[57] ABSTRACT

The invention provides (1) a titanium alloy with excellent corrosion resistance consisting essentially of 10–40 wt % of Mo, 0.1–15 wt % of Cr, and the balance of Ti and unavoidable impurities and (2) a titanium alloy according to (1) which further contains 0.01–2.0 wt % (in total) of Ru, Ir, Os, Pd, Pt, or/and Rh. The addition of Mo allows Ti-based alloys to form on the surface a protective film with a high concentration of Mo, whereby their corrosion resistance in non-oxidizing acids, such as hydrochloric and sulfuric acids, is markedly improved. In environments where oxidants are present, even but a few ppm in amount, Mo comes out in solution, seriously affecting the corrosion resistance of the alloys. To avoid this, Cr must also be added. The addition of Cr helps keep Mo from dissolving out and thereby prevent the deterioration of corrosion resistance by the action of oxidants in the environments. The platinum group elements, singly or in combination, further improve the corrosion resistance.

1 Claim, No Drawings

TITANIUM ALLOYS WITH EXCELLENT CORROSION RESISTANCE

FIELD OF THE INVENTION

This invention relates to titanium based alloys with excellent corrosion resistance and, more specifically, to a titanium based alloy containing Mo and Cr and a titanium based alloy containing Mo, Cr and Ru or other platinum group element(s) which exhibit excellent corrosion resistance even in any of high-temperature, high-concentration non-oxidizing acids containing oxidants.

BACKGROUND OF THE INVENTION

The chemical industry has in recent years made great strides of progress, with development of new processes and improvements of existing processes being steadily under way toward more labor-saving and more efficient operations. Accompanied with this, there is expanding demand for equipment materials having sufficient corrosion resistance for services in such severely corrosive environments as non-oxidizing acids typified by hydrochloric and sulfuric acids. Particularly, the corrosive environments surrounding the equipment materials are recently becoming more and more rigorous with spreading uses of high-temperature, high-concentration non-oxidizing acids. Also in the processing for disposal of waste liquors, waste gases, and solid refuses which involve in environment problems, the process has increased chances in which hydrochloric and sulfuric acids at high temperatures and high concentrations must be treated. From this viewpoint too, equipment materials capable of safely handling such acids are being required. Besides these circumstances, a more recent tendency is that, from the economical view point, more weight is placed on the total cost including maintenance cost rather than the initial investment only under the consideration of the ease of maintenance. The tendency is reflected by the increasing use of high-grade corrosion-resistant materials for the aforesaid environments.

Those corrosion-resistant materials, roughly divided into metallic and non-metallic, are being used in various fields according to their characteristics. The metallic materials in particular are used in heat exchangers where their heat transfer efficiency is valued and in the main portions of other equipment where their toughness in structure is prized. In view of these, there is a strong demand for metallic materials which combine reliable corrosion resistance with economical efficiency.

The metallic materials known in the art for use in such high-temperature, high-concentration non-oxidizing acids include Nb, Ta, Zr, "Hastelloy (trade mark)", and corrosion-resistant titanium alloys. Among them, Nb and Ta are excellent in corrosion resistance but the extremely high prices limit their utilization in industry. On the other hand, Zr and "Hastelloy" have the problem of their corrosion resistance being deteriorated by the presence of $Cl^-$.

Conventional corrosion-resistant titanium alloys, typified by the Ti-Pd alloy, are not adequately resistant to such non-oxidizing acids as hydrochloric and sulfuric acids. Ti-Mo alloys containing up to several ten percent of molybdenum (e.g., refer to "TRANSACTIONS OF THE ASM", Stern et al., Vol. 54, 1961, p. 286.) and Ti-Mo-Ru alloys enhanced in corrosion resistance by the further addition of a small amount of ruthenium of an relatively inexpensive precious metal (refer to Japanese Patent Application Public Disclosure No. 337389/1989.) are excellently resistant to the corrosive attacks of hydrochloric and sulfuric acids. These Ti-Mo-(Ru) alloys (which designates Ti-Mo alloys or Ti-Mo-Ru alloys) have beta-phase which is homogeneous in structure and therefore are easy to work. For the reason, they can be fabricated as equipment materials into diverse shapes. Moreover, the use of Mo, a metal less costly than Nb and Ta, makes these alloys more economical than the other high-grade corrosion-resistant materials.

The Ti-Mo-(Ru) alloys do prove outstandingly corrosion-resistant in a non-oxidizing acid, such as hydrochloric or sulfuric acid, as long as the acid is free from impurities. However, but when even a few ppm of an oxidizing agent is mixed as a foreign matter into these acids, the Ti-Mo-(Ru) alloys would pose a problem; serious deterioration of the corrosion resistance of the alloys due to overpassivation of Mo. Generally, in actual environments, the ingress of oxidants, such as traces of impure ions like $Fe^{3+}$ and $Cu^{2+}$ or dissolved oxygen in solution, is common. So, the susceptibility to the corrosive action of the oxidants is a fatal disadvantage that has severely restricted the industrial utilization of the Ti-Mo-(Ru) alloys. As stated above, the Ti-Mo-(Ru) alloys are highly resistant to the corrosive attacks of non-oxidizing acids, exhibit good workability, and provide good economy. Nevertheless, they have the fatal disadvantage as an industrial material of their corrosion resistance being seriously affected by the presence of a trace of an oxidant.

OBJECT OF THE INVENTION

The present invention has been perfected with the foregoing in view. The object of the present invention is to provide corrosion-resistant materials which exhibit excellent corrosion resistance in severely corrosive environments of non-oxidizing acids in which oxidants are present, and which possess as excellent workability and economy.

SUMMARY OF THE INVENTION

After extensive research the present inventors have now found that the addition of Cr to Ti-Mo alloys enable the latter to prove excellently corrosion-resistant even in severely corrosive environments of non-oxidizing acids in which oxidants are present. It has also been found that the addition of Cr to Ti-Mo alloys further including Ru or other platinum group element(s) imparts still greater corrosion resistance. The present invention, based on these findings, provides:

(1) a titanium alloy with excellent corrosion resistance consisting essentially of, all by weight, 10–40% of Mo, 0.1–15% of Cr, and the balance of Ti and unavoidable impurities and (2) a titanium alloy with excellent corrosion resistance consisting essentially of, all by weight, 10–40% of Mo, 0.1–15% of Cr, 0.01–2.0% (in total) of at least one selected from the group of Ru, Ir, Os, Pd, Pt, and Rh, and the balance of Ti and unavoidable impurities.

DETAILED DESCRIPTION OF THE INVENTION

In the titanium alloys of the present invention, Mo is added because it forms a protective film with a high concentration of Mo on the material surface, markedly improving its corrosion resistance in a non-oxidizing acid, such as hydrochloric or sulfuric acid. However, if an oxidant is present in the environment, even in an amount of but a few ppm, Mo will dissolve out and substantially reduce the corrosion resistance. It is for this reason that Cr must be added. The addition of Cr inhibits the dissolution of Mo and prevents the deterioration of corrosion resistance with oxidants present in the environment encountered.

The Ti-Mo-(platinum group element) alloy that further contains one or more of the platinum group elements of Ru, Ir, Os, Pd, Pt, and Rh is originally even more corrosion resistant than Ti-Mo alloy. The addition of Cr thereto results in a striking improvement in corrosion resistance of the alloy in the environments where oxidants are present.

The alloys of the invention, with the functions described above, show excellent corrosion resistance in high-temperature, high-concentration non-oxidizing acids that contain oxidants.

The lower limit of the Mo content is fixed at 10 wt % because, with a Mo content less than the limit, the resulting protective film is not sturdy enough to provide enhanced protection against corrosion. The upper limit of 40 wt % is set because further addition of Mo brings only a slight improvement in corrosion resistance and moreover such a large content of Mo which has a high melting point and is prone to segregation renders it difficult to obtain a homogeneous ingot, with deterioration of hot and cold workability.

The lower limit of the Cr content is specified to be 0.1 wt %, because a smaller Cr content fails to achieve in satisfactory manner the beneficial action of Cr and to improve the corrosion resistance in the presence of oxidants. The upper limit of 15 wt % is necessary because a larger addition of Cr reduces the workability and makes it difficult for the resulting alloy to form sheets or bars.

The lower limit of the content, in total, of at least one of the platinum group elements selected from the group consisting of Ru, Ir, Os, Pd, Pt, and Rh is 0.01 wt % because a smaller contents is no longer capable of attaining an adequate improvement in corrosion resistance. The upper limit of 2.0 wt % is intended to avoid an economical disadvantage of a larger addition beyond the level at which the favorable effect is saturated.

The alloys of the present invention, which result from the addition of Cr to the Ti-Mo alloy or the Ti-Mo-Ru or other platinum group element alloy exhibit satisfactory corrosion resistance from the industrial viewpoint, with very remarkable resistance in high-temperature high-concentration non-oxidizing acids in which oxidants are present.

The alloys of the invention, with the addition of Mo and Cr, attain metallic structures within the composition range of the invention in the state of a single beta-phase which is easy to work. Consequently, the alloys are not only hot-workable but also show very desirable cold workability; they can be readily worked into sheets, bars and wires. The products as equipment materials can easily be fabricated by bending, pressing, and other forming techniques into articles of various shapes.

EXAMPLES

The invention is illustrated by the following examples. As test materials, button ingots were made from melts prepared by adding varied amounts of Mo and Cr to Ti, or by further adding one or more of the elements Ru, Ir, Os, Pd, Pt, and Rh in varied amounts thereto. They were rolled hot and cold into sheets of 2 mm thickness. As comparative materials, Ti-Mo alloys, Ti-Mo-platinum group element alloys, and "Hastelloy C-276 (trade mark)" were prepared. The test materials after cold rolling were cut into pieces 20×20 mm square. The pieces were solution treated, finished on their surface with a #600 emery paper, and cleaned their surfaces. Each test piece thus obtained was subjected to a whole surface corrosion test in a boiling bath containing 10% hydrochloric acid with the addition of a predetermined amount of Fe, as an oxidant, and the corrosion speed was calculated. Also, the test materials were inspected to see if they had developed edge cracks upon cold rolling. The results are summarized in Table 1.

Referring to Table 1, Nos. 1 to 5 contained varying amounts of Mo, in the range from 5 to 50 wt %. In the absence of an oxidant (when $Fe^{3+}$ was not added), the corrosion resistance improved markedly with 10 wt % or more Mo, but more than 40 wt % Mo reduced cold workability seriously. Hence the Mo range between 10 and 40 wt %. It will be seen that even these alloys showed sharp decreases in corrosion resistance as the Fe, concentration increased.

Nos. 6 to 10 are alloys made by adding from 0.05 to 20 wt % of Cr to a Ti-20 wt % Mo alloy. The addition of 0.05 wt % Cr (No. 6) brought no resistance-improving effect, the corrosion resistance decreasing with the increase in the amount of $Fe^{3+}$, It is not until 0.1 wt % or more Cr is added that the corrosion resistance in the presence of $Fe^{3+}$ is improved. Hence the lower limit of 0.1 wt % for the addition of Cr. However, the addition of greater than 15.0 wt % aggravates the workability, with frequent edge crackings on cold rolling. For this reason, the upper limit of 15.0 wt % must be placed on the Cr content.

Nos. 11 to 15 are alloys prepared by adding from 0.005 to 4.0 wt % of Ru to a Ti-20 wt % Mo alloy. When there is no oxidant (without the addition of Fe, ), the addition of at least 0.01 wt % Ru improves the corrosion resistance over the Ti-20 wt % Mo alloy. The lower limit of the Ru content, therefore, must be 0.01 wt %. The addition of more than 2.0 wt % Ru causes the improving effect to be saturated, and there is no more necessity of adding the expensive Ru. Consequently, the upper limit of Ru is fixed at 2.0 wt %. It is obvious that even the Ti-Mo-Ru alloys lose their corrosion resistance sharply with the increase in the Fe, concentration.

Nos. 16 to 20 were prepared by adding from 0.05 to 20.0 wt % Cr to an Ti-20 wt % Mo-0.1 wt % Ru alloy. The alloys with 0.1 wt % or more Cr showed improved corrosion resistance when $Fe^{3+}$ was added and proved highly corrosion-resistant regardless of the presence or absence of an oxidant. On the other hand, more than 15 wt % Cr aggravated the cold workability extremely. For these reasons it is necessary to confine the Cr content within the range of 0.1 to 15.0 wt % as with the Ti-Mo alloys.

As presented in Tables 2 to 4, Nos. 21 through 70 were likewise tested to evaluate the effects of the elements of the other platinum group elements, i.e., Ir, Os, Pd, Pt and Rh as well as Cr upon corrosion resistance. The tendency observed was the same as with the Ti-Mo-Ru alloys.

Nos. 71 to 78 were examined to determine the effects of the combined addition of two or more of the elements Ru, Ir, Os, Pd, Pt and Rh. These combined elements proved as effective upon addition of Cr as with the addition of any one of them. Therefore, the total amount of these elements to be added is also limited within the range of 0.01 to 2.0 wt %.

No. 79 gives the results with "Hastelloy C-276", a material for comparison. It will be appreciated that the alloys of the invention is superior in corrosion resistance to "Hastelloy C-276", irrespective of the amount of Fe, added.

Thus, it has been confirmed that the alloys of the present invention, with the addition of Cr to Ti-Mo alloys and Ti-Mo-platinum group element alloys, have achieved a remarkable improvement in corrosion resistance in high-temperature, high-concentration non-oxidizing acids containing oxidants.

ADVANTAGE OF THE INVENTION

The alloys according to the invention exhibit excellent corrosion resistance in high-temperature, high-concentration non-oxidizing acids in which oxidants are present. Their beta-phase-based metallic structure makes them outstandingly workable. Further, the alloys are less costly than ordinary high-grade corrosion-resistant materials. These advantages enable them to achieve industrially very favorable effects as materials for chemical equipment.

TABLE 1

| | Results of corrosion tests (boiling 10% HCl) | | | | | | | | | | | | | |
|---|---|---|---|---|---|---|---|---|---|---|---|---|---|---|
| | Composition (wt %) bal. Ti | | | | | | | | $Fe^{3+}$ conc. (ppm) | | | | Work- | |
| No. | Mo | Cr | Ru | Ir | Os | Pd | Pt | Rh | None | 5 | 50 | 500 | ability | Remarks |
| 1 | 5 | — | — | — | — | — | — | — | 14.5 | 12.3 | 7.52 | 2.13 | ∘ | Comparative |
| 2 | 10 | — | — | — | — | — | — | — | 0.98 | 1.35 | 2.14 | 3.21 | ∘ | examples |
| 3 | 20 | — | — | — | — | — | — | — | 0.13 | 0.52 | 1.52 | 7.52 | ∘ | |
| 4 | 40 | — | — | — | — | — | — | — | 0.005 | 0.35 | 4.36 | 13.2 | ∘ | |
| 5 | 50 | — | — | — | — | — | — | — | 0.004 | 0.26 | 5.85 | 32.0 | x | |
| 6 | 20 | 0.05 | — | — | — | — | — | — | 0.13 | 0.54 | 3.23 | 7.43 | ∘ | |
| 7 | 20 | 0.1 | — | — | — | — | — | — | 0.15 | 0.15 | 0.17 | 0.21 | ∘ | Alloys of |
| 8 | 20 | 7.0 | — | — | — | — | — | — | 0.21 | 0.21 | 0.23 | 0.27 | ∘ | invention |
| 9 | 20 | 15.0 | — | — | — | — | — | — | 0.25 | 0.26 | 0.28 | 0.30 | ∘ | |
| 10 | 20 | 20.0 | — | — | — | — | — | — | 0.43 | 0.47 | 0.49 | 0.32 | x | Comparative |
| 11 | 20 | — | 0.005 | — | — | — | — | — | 0.12 | 0.63 | 3.40 | 7.32 | ∘ | examples |
| 12 | 20 | — | 0.01 | — | — | — | — | — | 0.03 | 0.54 | 3.21 | 7.11 | ∘ | |
| 13 | 20 | — | 0.50 | — | — | — | — | — | 0.01 | 0.64 | 3.38 | 7.31 | ∘ | |
| 14 | 20 | — | 2.0 | — | — | — | — | — | 0.007 | 0.74 | 3.49 | 8.32 | ∘ | |
| 15 | 20 | — | 4.0 | — | — | — | — | — | 0.006 | 0.77 | 3.53 | 8.78 | ∘ | |
| 16 | 20 | 0.05 | 0.1 | — | — | — | — | — | 0.01 | 0.63 | 3.31 | 7.07 | ∘ | |
| 17 | 20 | 0.1 | 0.1 | — | — | — | — | — | 0.02 | 0.08 | 0.12 | 0.13 | ∘ | Alloys of |
| 18 | 20 | 7.0 | 0.1 | — | — | — | — | — | 0.02 | 0.09 | 0.12 | 0.14 | ∘ | invention |
| 19 | 20 | 15.0 | 0.1 | — | — | — | — | — | 0.04 | 0.11 | 0.13 | 0.15 | ∘ | |
| 20 | 20 | 20.0 | 0.1 | — | — | — | — | — | 0.08 | 0.14 | 0.17 | 0.27 | x | Comp. ex. |

Notes:
1. Unit in mm/year
2. ∘ - No edge cracking on cold rolling. Δ - Slight cracking on cold rolling. x - Serious cracking on cold rolling.

TABLE 2

| | Results of corrosion tests (boiling 10% HCl) | | | | | | | | | | | | | |
|---|---|---|---|---|---|---|---|---|---|---|---|---|---|---|
| | Composition (wt %) bal. Ti | | | | | | | | $Fe^{3+}$ conc. (ppm) | | | | Work- | |
| No. | Mo | Cr | Ru | Ir | Os | Pd | Pt | Rh | None | 5 | 50 | 500 | ability | Remarks |
| 21 | 25 | — | — | 0.005 | — | — | — | — | 0.11 | 0.58 | 3.84 | 7.68 | ∘ | Comparative |
| 22 | 20 | — | — | 0.01 | — | — | — | — | 0.05 | 0.61 | 3.81 | 7.35 | ∘ | examples |
| 23 | 20 | — | — | 0.50 | — | — | — | — | 0.02 | 0.66 | 3.75 | 7.53 | ∘ | |
| 24 | 40 | — | — | 2.0 | — | — | — | — | 0.008 | 0.71 | 3.88 | 8.24 | ∘ | |
| 25 | 50 | — | — | 4.0 | — | — | — | — | 0.007 | 0.83 | 4.12 | 8.84 | ∘ | |
| 26 | 20 | 0.05 | — | 0.1 | — | — | — | — | 0.02 | 0.67 | 3.57 | 7.35 | ∘ | |
| 27 | 20 | 0.1 | — | 0.1 | — | — | — | — | 0.02 | 0.07 | 0.11 | 0.13 | ∘ | Alloys of |
| 28 | 20 | 7.0 | — | 0.1 | — | — | — | — | 0.02 | 0.10 | 0.12 | 0.13 | ∘ | invention |
| 29 | 20 | 15.0 | — | 0.1 | — | — | — | — | 0.04 | 0.10 | 0.12 | 0.16 | ∘ | |
| 30 | 20 | 20.0 | — | 0.1 | — | — | — | — | 0.07 | 0.13 | 0.15 | 0.25 | x | Comparative |
| 31 | 20 | — | — | — | 0.005 | — | — | — | 0.10 | 0.68 | 3.85 | 7.13 | ∘ | examples |
| 32 | 20 | — | — | — | 0.01 | — | — | — | 0.02 | 0.62 | 3.65 | 7.23 | ∘ | |
| 33 | 20 | — | — | — | 0.50 | — | — | — | 0.01 | 0.58 | 3.43 | 7.25 | ∘ | |
| 34 | 20 | — | — | — | 2.0 | — | — | — | 0.006 | 0.76 | 3.59 | 8.43 | ∘ | |
| 35 | 20 | — | — | — | 4.0 | — | — | — | 0.007 | 0.73 | 3.68 | 9.04 | ∘ | |
| 36 | 20 | 0.05 | — | — | 0.1 | — | — | — | 0.02 | 0.66 | 3.41 | 7.17 | ∘ | |
| 37 | 20 | 0.1 | — | — | 0.1 | — | — | — | 0.02 | 0.07 | 0.10 | 0.12 | ∘ | Alloys of |
| 38 | 20 | 7.0 | — | — | 0.1 | — | — | — | 0.02 | 0.10 | 0.12 | 0.13 | ∘ | invention |
| 39 | 20 | 15.0 | — | — | 0.1 | — | — | — | 0.05 | 0.11 | 0.15 | 0.16 | ∘ | |
| 40 | 20 | 20.0 | — | — | 0.1 | — | — | — | 0.08 | 0.14 | 0.17 | 0.27 | x | Comp. ex. |

Notes:
1. Unit in mm/year
2. ∘ - No edge cracking on cold rolling. Δ - Slight cracking on cold rolling. x - Serious cracking on cold rolling.

TABLE 3

| | Results of corrosion tests (boiling 10% HCl) | | | | | | | | | | | | | |
|---|---|---|---|---|---|---|---|---|---|---|---|---|---|---|
| | Composition (wt %) bal. Ti | | | | | | | | $Fe^{3+}$ conc. (ppm) | | | | Work- | |
| No. | Mo | Cr | Ru | Ir | Os | Pd | Pt | Rh | None | 5 | 50 | 500 | ability | Remarks |
| 41 | 5 | — | — | — | — | 0.005 | — | — | 0.11 | 0.75 | 3.86 | 7.53 | ∘ | Comparative |

TABLE 3-continued

| | Results of corrosion tests (boiling 10% HCl) | | | | | | | | | | | | | |
|---|---|---|---|---|---|---|---|---|---|---|---|---|---|---|
| | Composition (wt %) bal. Ti | | | | | | | | $Fe^{3+}$ conc. (ppm) | | | | Work- | |
| No. | Mo | Cr | Ru | Ir | Os | Pd | Pt | Rh | None | 5 | 50 | 500 | ability | Remarks |
| 42 | 20 | — | — | — | — | 0.01 | — | — | 0.04 | 0.58 | 3.53 | 7.12 | ∘ | examples |
| 43 | 20 | — | — | — | — | 0.50 | — | — | 0.05 | 0.68 | 4.21 | 7.68 | ∘ | |
| 44 | 20 | — | — | — | — | 2.0 | — | — | 0.01 | 0.71 | 4.02 | 8.64 | ∘ | |
| 45 | 20 | — | — | — | — | 4.0 | — | — | 0.008 | 0.83 | 3.58 | 9.23 | ∘ | |
| 46 | 20 | 0.05 | — | — | — | 0.1 | — | — | 0.01 | 0.76 | 3.81 | 7.57 | ∘ | |
| 47 | 20 | 0.1 | — | — | — | 0.1 | — | — | 0.01 | 0.09 | 0.13 | 0.11 | ∘ | Alloys of |
| 48 | 20 | 7.0 | — | — | — | 0.1 | — | — | 0.02 | 0.10 | 0.10 | 0.13 | ∘ | invention |
| 49 | 20 | 15.0 | — | — | — | 0.1 | — | — | 0.04 | 0.13 | 0.15 | 0.15 | ∘ | |
| 50 | 20 | 20.0 | — | — | — | 0.1 | — | — | 0.07 | 0.16 | 0.22 | 0.24 | x | Comparative |
| 51 | 20 | — | — | — | — | — | 0.005 | — | 0.11 | 0.72 | 3.89 | 8.21 | ∘ | examples |
| 52 | 20 | — | — | — | — | — | 0.01 | — | 0.05 | 0.57 | 3.42 | 7.56 | ∘ | |
| 53 | 20 | — | — | — | — | — | 0.50 | — | 0.02 | 0.65 | 3.76 | 7.43 | ∘ | |
| 54 | 20 | — | — | — | — | — | 2.0 | — | 0.008 | 0.78 | 3.89 | 8.04 | ∘ | |
| 55 | 20 | — | — | — | — | — | 4.0 | — | 0.007 | 0.83 | 3.91 | 9.13 | ∘ | |
| 56 | 20 | 0.05 | — | — | — | — | 0.1 | — | 0.03 | 0.68 | 3.25 | 7.52 | ∘ | |
| 57 | 20 | 0.1 | — | — | — | — | 0.1 | — | 0.02 | 0.09 | 0.10 | 0.11 | ∘ | Alloys of |
| 58 | 20 | 7.0 | — | — | — | — | 0.1 | — | 0.05 | 0.11 | 0.13 | 0.15 | ∘ | invention |
| 59 | 20 | 15.0 | — | — | — | — | 0.1 | — | 0.04 | 0.12 | 0.13 | 0.14 | ∘ | |
| 60 | 20 | 20.0 | — | — | — | — | 0.1 | — | 0.09 | 0.16 | 0.23 | 0.31 | x | Comp. ex. |

Notes:
1. Unit in mm/year
2. ∘ - No edge cracking on cold rolling. Δ - Slight cracking on cold rolling. x - Serious cracking on cold rolling.

TABLE 4

| | Results of corrosion tests (boiling 10% HCl) | | | | | | | | | | | | | |
|---|---|---|---|---|---|---|---|---|---|---|---|---|---|---|
| | Composition (wt %) bal. Ti | | | | | | | | $Fe^{3+}$ conc. (ppm) | | | | Work- | |
| No. | Mo | Cr | Ru | Ir | Os | Pd | Pt | Rh | None | 5 | 50 | 500 | ability | Remarks |
| 61 | 20 | — | — | — | — | — | — | 0.005 | 0.15 | 0.68 | 3.85 | 7.68 | ∘ | Comparative |
| 62 | 20 | — | — | — | — | — | — | 0.01 | 0.05 | 0.61 | 3.64 | 7.20 | ∘ | examples |
| 63 | 20 | — | — | — | — | — | — | 0.50 | 0.04 | 0.72 | 3.86 | 7.41 | ∘ | |
| 64 | 20 | — | — | — | — | — | — | 2.0 | 0.009 | 0.76 | 3.56 | 8.60 | ∘ | |
| 65 | 20 | — | — | — | — | — | — | 4.0 | 0.005 | 0.81 | 3.68 | 9.14 | ∘ | |
| 66 | 20 | 0.05 | — | — | — | — | — | 0.1 | 0.02 | 0.62 | 3.45 | 7.62 | ∘ | |
| 67 | 20 | 0.1 | — | — | — | — | — | 0.1 | 0.03 | 0.09 | 0.10 | 0.12 | ∘ | Alloys of |
| 68 | 20 | 7.0 | — | — | — | — | — | 0.1 | 0.02 | 0.10 | 0.11 | 0.14 | ∘ | invention |
| 69 | 20 | 15.0 | — | — | — | — | — | 0.1 | 0.03 | 0.13 | 0.12 | 0.16 | ∘ | |
| 70 | 20 | 20.0 | — | — | — | — | — | 0.1 | 0.10 | 0.15 | 0.19 | 0.27 | x | |
| 71 | 20 | — | 0.04 | — | — | 0.03 | — | — | 0.01 | 0.62 | 3.32 | 7.21 | ∘ | Comp. ex. |
| 72 | 20 | 7.0 | 0.04 | — | — | 0.03 | — | — | 0.02 | 0.08 | 0.11 | 0.13 | ∘ | Invention |
| 73 | 20 | — | 0.04 | — | 0.03 | — | 0.03 | — | 0.009 | 0.57 | 3.57 | 7.31 | ∘ | Comp. ex. |
| 74 | 20 | 7.0 | 0.04 | — | 0.03 | — | 0.03 | — | 0.01 | 0.07 | 0.10 | 0.12 | ∘ | Invention |
| 75 | 20 | — | 0.04 | 0.03 | — | 0.03 | — | 0.03 | 0.02 | 0.63 | 3.16 | 7.21 | ∘ | Comp. ex. |
| 76 | 20 | 7.0 | 0.04 | — | — | 0.03 | — | 0.03 | 0.02 | 0.09 | 0.11 | 0.14 | ∘ | Invention |
| 77 | 20 | — | 0.02 | 0.01 | 0.02 | 0.02 | 0.01 | 0.02 | 0.02 | 0.61 | 3.70 | 7.68 | ∘ | Comp. ex. |
| 78 | 20 | 0.7 | 0.02 | 0.01 | 0.02 | 0.02 | 0.01 | 0.02 | 0.04 | 0.09 | 0.09 | 0.11 | ∘ | Invention |
| 79 | Hastelloy C-276 | | | | | | | | 5.80 | 6.23 | 8.25 | 12.3 | ∘ | Comp. ex. |

Notes:
1. Unit in mm/year
2. ∘ - No edge cracking on cold rolling. Δ - Slight cracking on cold rolling. x - Serious cracking on cold rolling.

What we claim is:

1. A titanium alloy with excellent corrosion resistance consisting essentially of, all by weight, Mo: 10 to 40%, Cr: 0.1 to 15%, and at least one selected from the group consisting of Ru, Ir, Os, Pd, Pt and Rh: 0.01 to 2.0% in total, the balance being of Ti and unavoidable impurities.

* * * * *